US007652642B2

(12) United States Patent
Moon

(10) Patent No.: US 7,652,642 B2
(45) Date of Patent: Jan. 26, 2010

(54) PLASMA DISPLAY APPARATUS AND DRIVING METHOD THEREOF

(75) Inventor: Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 673 days.

(21) Appl. No.: 11/302,433

(22) Filed: Dec. 14, 2005

(65) Prior Publication Data

US 2006/0125728 A1 Jun. 15, 2006

(30) Foreign Application Priority Data

Dec. 14, 2004 (KR) ..... 10-2004-0105778

(51) Int. Cl.
*G09G 3/28* (2006.01)

(52) U.S. Cl. ..... 345/68; 345/60; 345/55; 345/41; 345/42

(58) Field of Classification Search ..... 345/68, 345/60, 55, 41–42
See application file for complete search history.

(56) References Cited

U.S. PATENT DOCUMENTS 6,762,567 B2 * 7/2004 Ide ..... 315/169.4
2003/0179160 A1 * 9/2003 Yamamoto et al. ..... 345/60
2005/0088376 A1 * 4/2005 Inoue et al. ..... 345/60

FOREIGN PATENT DOCUMENTS

| | | | |
|---|---|---|---|
| CN | 1475005 | A | 2/2004 |
| CN | 1327252 | A | 4/2006 |
| EP | 1347433 | A2 | 9/2003 |
| JP | 11-109914 | | 4/1999 |
| JP | 2003-280570 | | 10/2003 |

* cited by examiner

*Primary Examiner*—Richard Hjerpe
*Assistant Examiner*—Leonid Shapiro
(74) *Attorney, Agent, or Firm*—Birch, Stewart, Kolasch & Birch, LLP

(57) ABSTRACT

There is provided a plasma display apparatus and a driving method of a plasma display panel. The plasma display apparatus comprises a plasma display panel comprising a first electrode and a second electrode, and an electrode driver alternatively applying a sustain pulse of a first polarity to the first electrode and the second electrode and applying a pulse of a second polarity opposite to a first polarity after a magnitude of a voltage of a sustain pulse of a first polarity is maximized. Therefore, it is possible to increase discharge efficiency without rising a driving voltage or increasing an electrode space by increasing an amount of space discharge.

13 Claims, 9 Drawing Sheets

PLASMA DISPLAY APPARATUS AND DRIVING METHOD THEREOF

This Nonprovisional application claims priority under 35 U.S.C. § 119(a) on Patent Application No. 10-2004-0105778 filed in Korea on Dec. 14, 2004 the entire contents of which are hereby incorporated by reference.

BACKGROUND OF THE INVENTION

1. Field of the Invention

The present document relates to a plasma display apparatus and a driving method thereof.

2. Description of the Background Art

FIG. 1 is a view illustrating a discharge shape formed upon a regular glow discharge. An oblique line area shown in FIG. 1 is a bright area emitting a large amount of light. If a DC voltage of a predetermined magnitude or more is applied to a cathode electrode and an anode electrode, an inside of a discharge tube is divided into a cathode glow, a negative glow, a positive column, and an anode glow and emits light.

At this time, because a light emitting amount of visible rays or ultraviolet rays in a negative glow area is larger than that of visible rays or ultraviolet rays generating in a positive column area, negative glow discharge is mainly used in a plasma display panel of a general three electrode surface-discharge structure.

FIG. 2 is a conventional energy recovery circuit diagram and FIG. 3 is a diagram illustrating a sustain pulse waveform formed by a conventional energy recovery circuit. A sustain pulse as in FIG. 3 formed by a conventional energy recovery circuit forms a negative glow discharge of FIG. 1. Therefore, because a moving distance of an electron and art ion is short within a discharge space, light emits only in a section in which a sustain pulse rises and only wall charges are charged without emitting light in the other sections. Therefore, discharge efficiency is not good.

On the other hand, because high brightness and high efficiency of the plasma display panel are continuously required, a method of using a positive column area having discharge efficiency better than negative glow discharge is considered. In the positive column area, because discharge is performed by collision of an electron and an ion accelerated by an electric field which is greatly formed in a cathode dark space, discharge efficiency is good.

However, a distance between a cathode electrode and an anode electrode should be a predetermined value or more to use discharge of a positive column area. That is, as shown in FIG. 1, a positive column area is formed in an anode area while a negative glow area is formed near a cathode electrode.

Therefore, because a space between a scan electrode and a sustain electrode increases to use a positive column area in the plasma display panel, there is a problem that a size of a cell increases.

In addition, there is a problem that a discharge firing voltage increases as a space between electrodes increases. That is, a discharge firing voltage Vf can be expressed as a multiplication function of a pressure P of a discharge gas and a distance d between electrodes depending on a Paschen's law. If the pressure P of the discharge gas is constant, a magnitude of a discharge firing voltage Vf is proportional to a distance d between electrodes. Therefore, if the distance d between electrodes increases to use a positive column area, there is a problem that a discharge firing voltage Vf also increases.

SUMMARY OF THE INVENTION

Accordingly, an object of the present invention is to solve at least the problems and disadvantages of the background art.

An object of the present invention is to provide a driving apparatus and a driving method of a plasma display panel which can increase discharge efficiency without increasing a distance between electrodes or a discharge firing voltage.

According to an aspect of the present invention, there is provided a plasma display apparatus comprising a plasma display panel comprising a first electrode and a second electrode, and an electrode driver alternatively applying a sustain pulse of a first polarity to the first electrode and the second electrode and applying a pulse of a second polarity opposite to the first polarity after a magnitude of a voltage of the sustain pulse of a first polarity is maximized.

According to another aspect of the present invention, there is provided a plasma display apparatus comprising a plasma display panel comprising a first electrode and a second electrode, a first energy recovery unit supplying the first energy to the plasma display panel through the first electrode with resonance or recovering the first energy from the plasma display panel through the first electrode with resonance, a first positive voltage supply unit supplying a first positive voltage to the first electrode after the first energy is supplied, a first negative voltage supply unit supplying a first negative voltage to the first electrode while the first energy is recovered or after the first energy is recovered, a second energy recovery unit supplying a second energy to the plasma display panel through the second electrode with resonance or recovering the second energy from the plasma display panel through the second electrode with resonance, a second positive voltage supply unit supplying a second positive voltage to the second electrode after the second energy is supplied, and a second negative voltage supply unit supplying the second negative voltage to the second electrode while the second energy is recovered or after the second energy is recovered.

According to still another aspect of the present invention, there is provided a driving method of a plasma display panel comprising a first electrode and a second electrode, comprising supplying a first energy to the plasma display panel through the first electrode with resonance, supplying a first positive voltage to the first electrode after the first energy is supplied, recovering the first energy from the first electrode with resonance, supplying a first negative voltage to the first electrode while the first energy is recovered or after the first energy is recovered, supplying a second energy to the plasma display panel through the second electrode with resonance, supplying a second positive voltage to the second electrode after the second energy is supplied, recovering the second energy from the second electrode with resonance, and supplying a second negative voltage to the second electrode while the second energy is recovered or after the second energy is recovered.

According to the present invention, it is possible to increase discharge efficiency without rising of a driving voltage or increasing an electrode distance by increasing an amount of space charges by means of applying a negative pulse upon falling of a sustain pulse.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
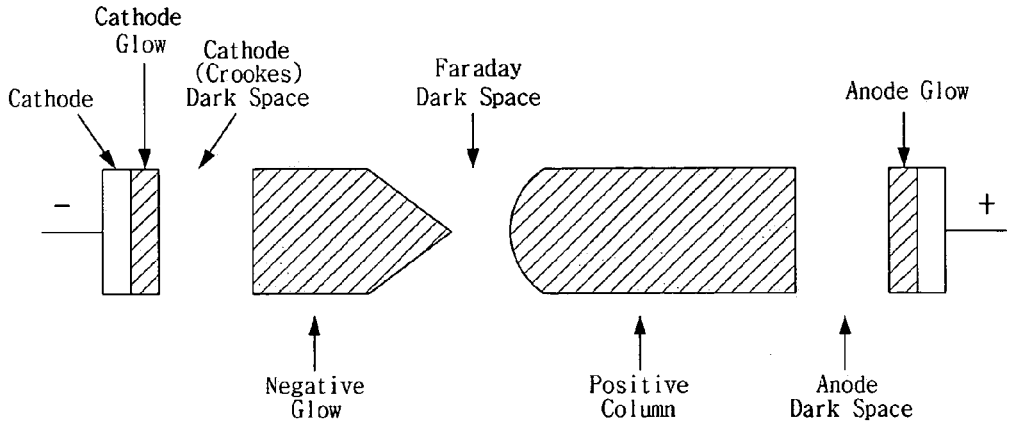
FIG. 1 is a view illustrating a discharge shape formed upon regular glow discharge.
Figure 2:
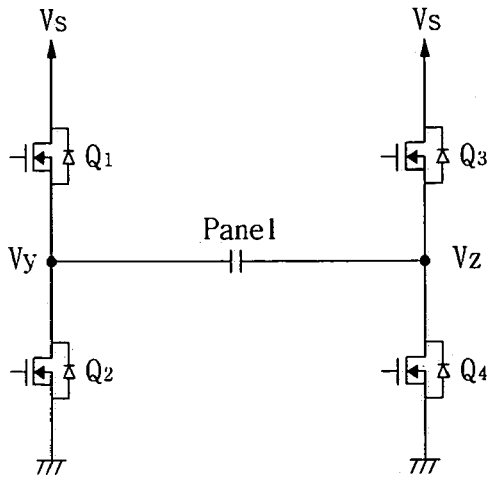
FIG. 2 is a conventional energy recovery circuit diagram.
Figure 3:
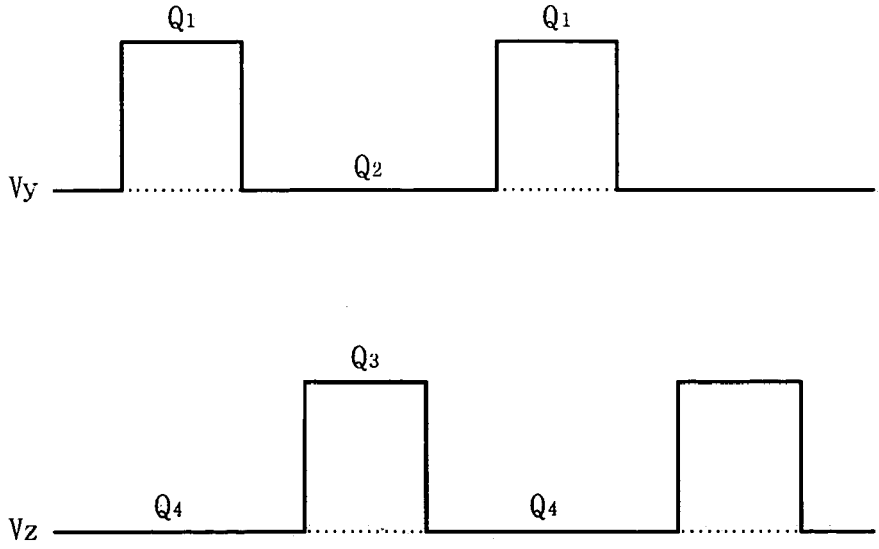
FIG. 3 is a diagram illustrating a sustain pulse waveform formed by a conventional energy recovery circuit.

Embodiments of the present invention will be described in a more detailed manner with reference to the drawings.

According to an aspect of the present invention, there is provided a plasma display apparatus comprising a plasma display panel comprising a first electrode and a second electrode, and an electrode driver alternatively applying a sustain pulse of a first polarity to the first electrode and the second electrode and applying a pulse of a second polarity opposite to the first polarity after a magnitude of a voltage of the sustain pulse of a first polarity is maximized.

The sustain pulse of the first polarity may be a positive sustain pulse and the pulse of a second polarity may be the negative pulse.

The electrode driver may apply the pulse of the second polarity after a voltage of the sustain pulse of the first polarity becomes a ground level voltage.

According to another aspect of the present invention, there is provided a plasma display apparatus comprising a plasma display panel comprising a first electrode and a second electrode, a first energy recovery unit supplying the first energy to the plasma display panel through the first electrode with resonance or recovering the first energy from the plasma display panel through the first electrode with resonance, a first positive voltage supply unit supplying a first positive voltage to the first electrode after the first energy is supplied, a first negative voltage supply unit supplying a first negative voltage to the first electrode while the first energy is recovered or after the first energy is recovered, a second energy recovery unit supplying a second energy to the plasma display panel through the second electrode with resonance or recovering the second energy from the plasma display panel through the second electrode with resonance, a second positive voltage supply unit supplying a second positive voltage to the second electrode after the second energy is supplied, and a second negative voltage supply unit supplying the second negative voltage to the second electrode while the second energy is recovered or after the second energy is recovered.

The first positive voltage may be a positive sustain voltage for sustaining discharge.

The second positive voltage may be a positive sustain voltage for sustaining discharge.

The first energy may correspond to 0.5 times of the first positive voltage.

The second energy may correspond to 0.5 times of the second positive voltage.

The first energy recovery unit may comprise a first energy recovery capacitor storing the first energy, a first supply switch forming a supply path of the first energy stored in the first energy recovery capacitor, a first recovery diode forming a recovery path of the first energy which is recovered through the first electrode, and a first inductor forming resonance when the first energy is supplied or recovered, and the second energy recovery unit comprises a second energy recovery capacitor storing the second energy, a second supply switch forming a supply path of the second energy stored in the second energy recovery capacitor, a second recovery diode forming a recovery path of the second energy recovered through the second electrode, and a second inductor forming resonance when the second energy is supplied or recovered.

The first recovery diode may comprise a cathode terminal commonly connected to one terminal of the first supply switch and one terminal of the first energy recovery capacitor and an anode terminal commonly connected to the other terminal of the first supply switch and one terminal of the first inductor, and the second recovery diode comprises a cathode terminal commonly connected to one terminal of the second supply switch and one terminal of the second energy recovery capacitor and an anode terminal commonly connected to the other terminal of the second supply switch and one terminal of the second inductor.

The first recovery diode may be a body diode of the first supply switch.

The second recovery diode may be a body diode of the second supply switch.

The first energy recovery unit may comprise a first energy recovery capacitor storing the first energy, a first supply switch forming a supply path of the first energy stored in the first energy recovery capacitor, a first recovery switch forming a recovery path of the first energy recovered to the first energy recovery capacitor, and a first inductor supplying or recovering the first energy with resonance; and the second energy recovery unit comprises a second energy recovery capacitor storing the second energy, a second supply switch forming a supply path of the second energy stored in the second energy recovery capacitor, a second recovery switch forming a recovery path of the second energy recovered to the second energy recovery capacitor, and a second inductor supplying or recovering the second energy with resonance.

The first negative voltage supply unit may supply the first negative voltage having a ramp waveform and the second negative voltage supply unit may supply the second negative voltage having a ramp waveform.

The first negative voltage supply unit may supply the first negative voltage having a square waveform and the second negative voltage supply unit may supply the second negative voltage having a square waveform.

The first negative voltage supply unit may supply the first negative voltage having a triangular waveform and the second negative voltage supply unit may supply the second negative voltage having a triangular waveform.

The first negative voltage supply unit may comprise a first negative voltage supply switch of which a gate terminal is connected to a first variable resistor, and which operates in an active area, and the second negative voltage supply unit comprises the second negative voltage supply switch of which a gate terminal is connected to a second variable resistor, and operating in an active area.

According to still another aspect of the present invention, there is provided a driving method of a plasma display panel comprising a first electrode and a second electrode, comprising supplying a first energy to the plasma display panel through the first electrode with resonance, supplying a first positive voltage to the first electrode after the first energy is supplied, recovering the first energy from the first electrode with resonance, supplying a first negative voltage to the first electrode while the first energy is recovered or after the first energy is recovered, supplying a second energy to the plasma display panel through the second electrode with resonance, supplying a second positive voltage to the second electrode after the second energy is supplied, recovering the second energy from the second electrode with resonance, and supplying a second negative voltage to the second electrode while the second energy is recovered or after the second energy is recovered.

The first negative voltage may be a peak pulse having a triangular waveform and the second negative voltage is a peak pulse having a triangular waveform.

The first negative voltage may be a peak pulse having a square waveform and the second negative voltage is a peak pulse having a square waveform.

The first negative voltage may be a peak pulse having a ramp waveform and the second negative voltage is a peak pulse having a ramp waveform.

Hereinafter, exemplary embodiments of the present invention will be described in detail with reference to the accompanying drawings.

Figure 4:
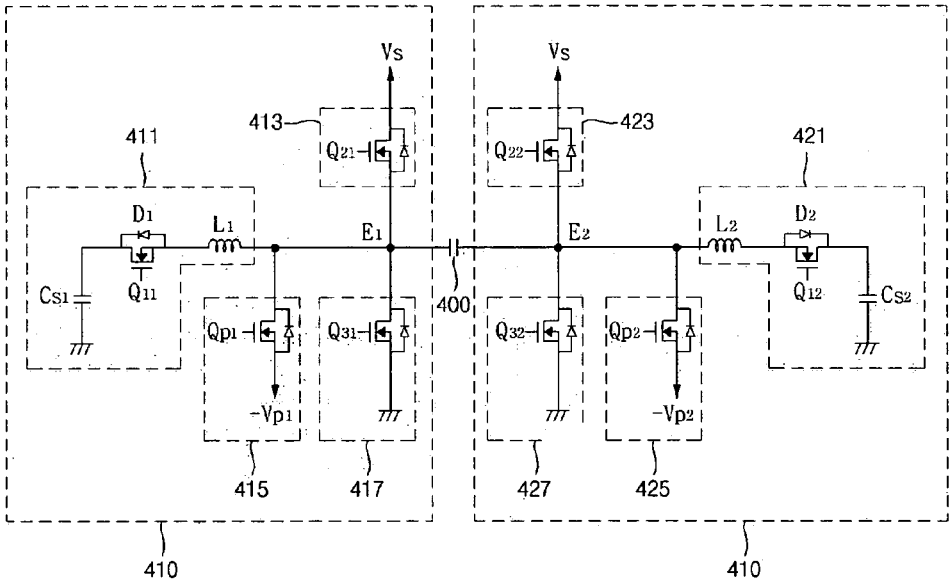
FIG. 4 is a diagram illustrating a plasma display apparatus according to a first embodiment of the present invention.

FIG. 4 shows a plasma display apparatus according to a first embodiment of the present invention. As shown in FIG. 4, the plasma display apparatus according to the first embodiment of the present invention comprises a plasma display panel 400 and an electrode driver 410.

<Plasma Display Panel>

A plasma display panel 400 comprises a first electrode (E1) and a second electrode (E2). The first electrode (E1) is a scan electrode (Y) and the second electrode (E2) is a sustain electrode (Z). The plasma display panel 400 receives a reset pulse to uniform wall charges of a whole discharge cell through a scan electrode (Y) in a reset period and receives a scan pulse to select a discharge cell through a scan electrode (Y) in an address period. In addition, the plasma display panel 400 alternatively receives a sustain pulse to sustain discharge of the selected discharge cell in the scan electrode (Y) and a sustain electrode (Z) in a sustain period.

An electrode driver 410 alternatively applies a sustain pulse of the first polarity to the first electrode (E1) and the second electrode (E2) and applies a pulse of the second polarity opposite to the first polarity after a magnitude of a voltage of a sustain pulse is maximized. The electrode driver 410 applies a pulse of the second polarity after a voltage of a sustain pulse of the first polarity becomes a ground level voltage. A sustain pulse of the first polarity is a positive sustain pulse and a pulse of the second polarity is a negative pulse.

The electrode driver 410 comprises a first energy recovery unit 411, a first positive voltage supply unit 413, a first negative voltage supply unit 415, a first reference voltage supply unit 417, a second energy recovery unit 421, a second positive voltage supply unit 423, a second negative voltage supply unit 425, and a second reference voltage supply unit 427.

<First Energy Recovery Unit>

A first energy recovery unit 411 supplies the first energy to the plasma display panel 400 through the first electrode (E1) with resonance and recovers the first energy from the plasma display panel 400 through the first electrode (E1) with resonance.

<First Positive Voltage Supply Unit>

The first positive voltage supply unit 413 supplies a first positive voltage to the first electrode (E1) after the first energy is supplied by the first energy recovery unit 411. The first positive voltage is a sustain voltage (Vs).

A sustain voltage is a voltage for sustaining a sustain discharge. The first positive voltage supply unit 413 comprises a first positive voltage supply switch (Q21). One terminal of the first positive voltage supply switch (Q21) is connected to the first electrode (E1) of the plasma display panel and the other terminal of the first positive voltage supply switch (Q21) is connected to a first positive voltage source.

<First Negative Voltage Supply Unit>

A first negative voltage supply unit 415 supplies a first negative voltage to the first electrode (E1) while the first energy is recovered or after the first energy is recovered to the first energy recovery unit 411. The first negative voltage supply unit 415 comprises a first negative voltage supply switch (Qp1). One terminal of the first negative voltage supply switch (Qp1) is connected to a first negative voltage source (−Vp1) and the other terminal of the first negative voltage supply switch (Qp1) is connected to the first electrode (E1) of the plasma display panel 400.

<First Reference Voltage Supply Unit>

A first reference voltage supply unit 417 supplies a first reference voltage to the first electrode. (E1) after the first negative voltage is supplied by the first negative voltage supply unit 415. The first reference voltage is a ground level voltage. The first reference voltage supply unit 417 comprises a first reference voltage supply switch (Q31). One terminal of the first reference voltage supply switch (Q31) is connected to the first electrode (E1) of plasma display panel 400 and the other terminal of the first reference voltage supply switch (Q31) is connected to the first reference voltage source.

The first energy recovery unit 411 comprised in the plasma display apparatus according to the first embodiment of the present invention comprises a first energy recovery capacitor (Cs1), a first supply switch (Q11), a first recovery diode (D1), and a first inductor (L1).

The first energy recovery capacitor (Cs1) stores the first energy which is supplied or recovered. The first energy stored in the first energy recovery capacitor (Cs1) corresponds to 0.5 times of the first positive voltage (Vs1).

The first supply switch (Q11) is turned on and forms a supply path of the first energy stored in the first energy recovery capacitor (Cs1). One terminal of the first supply switch (Q11) is connected to the first energy recovery capacitor (Cs1) and the other terminal of the first supply switch (Q11) is connected to one terminal of the first inductor (L1).

The first recovery diode (D1) comprises a cathode terminal commonly connected to one terminal of the first supply switch (Q11) and one terminal of the first energy recovery capacitor (Cs1) and an anode terminal commonly connected to the other terminal of the first supply switch (Q11) and one terminal of the first inductor (L1). The first recovery diode (D1) forms a recovery path of the first energy recovered through the first electrode (E1) of the plasma display panel 400. The first supply switch (Q11) is a field effect transistor (FET) and the first recovery diode (D1) is a body diode of the FET.

The first inductor (L1) supplies the first energy supplied from the first energy recovery capacitor (Cs1) and the first supply switch (Q11) to the first electrode (E1) through resonance with a capacitance of the plasma display panel 400. In addition, the first inductor (L1) allows the first energy to be recovered from the first electrode (E1) to the first diode (D1) and the first energy recovery capacitor (Cs1) through resonance.

<Second Energy Recovery Unit>

The second energy recovery unit 421 supplies the second energy to the plasma display panel 400 through the second electrode (E2) with resonance and recovers the second energy from the plasma display panel 400 through the second electrode (E2) with resonance.

<Second Positive Voltage Supply Unit>

A second positive voltage supply unit 423 supplies a second positive voltage to the second electrode (E2) after the second energy is supplied by the second energy recovery unit 421.

<Second Negative Voltage Supply Unit>

A second negative voltage supply unit 425 supplies a second negative voltage to the second electrode (E2) while the second energy is recovered or after the second energy is recovered to the second energy recovery unit 421. The second negative voltage supply unit 425 comprises a second negative voltage supply switch (Qp2). One terminal of the second negative voltage supply switch (Qp2) is connected to a second negative voltage source (−Vp2), and the other terminal of the second negative voltage supply switch (Qp2) is connected to the second electrode (E2) of the plasma display panel 400.

<Second Reference Voltage Supply Unit>

A second reference voltage supply unit 427 supplies the second reference voltage to the second electrode (E2) after the second negative voltage is supplied by the second negative voltage supply unit 425. The second reference voltage is a ground level voltage. The second reference voltage supply unit 427 comprises the second reference voltage supply switch (Q32). One terminal of the second reference voltage supply switch (Q32) is connected to the second electrode (E2) of the plasma display panel 400 and the other terminal of the second reference voltage supply switch (Q32) is connected to the second reference voltage source.

The second energy recovery unit 421 comprised in plasma display apparatus according to the first embodiment of the present invention comprises a second energy recovery capacitor (Cs2), a second supply switch (Q12), a second recovery diode (D2), and a second inductor (L2).

The second energy recovery capacitor (Cs2) stores the second energy which is supplied or recovered. The second energy stored in the second energy recovery capacitor (Cs2) corresponds to 0.5 times of the second positive voltage (Vs).

The second supply switch (Q12) is turned on and forms a supply path of the second energy stored in the second energy recovery capacitor (Cs2). One terminal of the second supply switch (Q12) is connected to the second energy recovery capacitor (Cs2) and the other terminal of the second supply switch (Q12) is connected to one terminal of the second inductor (L2).

The second recovery diode (D2) comprises a cathode terminal commonly connected to one terminal of the second supply switch (Q12) and one terminal of the second energy recovery capacitor (Cs2) and an anode terminal commonly connected to the other terminal of the second supply switch (Q12) and one terminal of the second inductor (L2). The second recovery diode (D2) forms a recovery path of the second energy recovered through the second electrode (E2) of the plasma display panel 400. The second supply switch (Q12) is a field effect transistor (FET) and the second recovery diode (D2) is a body diode of the FET.

The second inductor (L2) supplies the second energy supplied from the second energy recovery capacitor (Cs2) and the second supply switch (Q12) to the first electrode (E1) through resonance with a capacitance of the plasma display panel 400. In addition, the second inductor (L2) allows the second energy to be recovered from the second electrode (E2) to the second diode (D2) and the second energy recovery capacitor (Cs2) through resonance.

Figure 5:
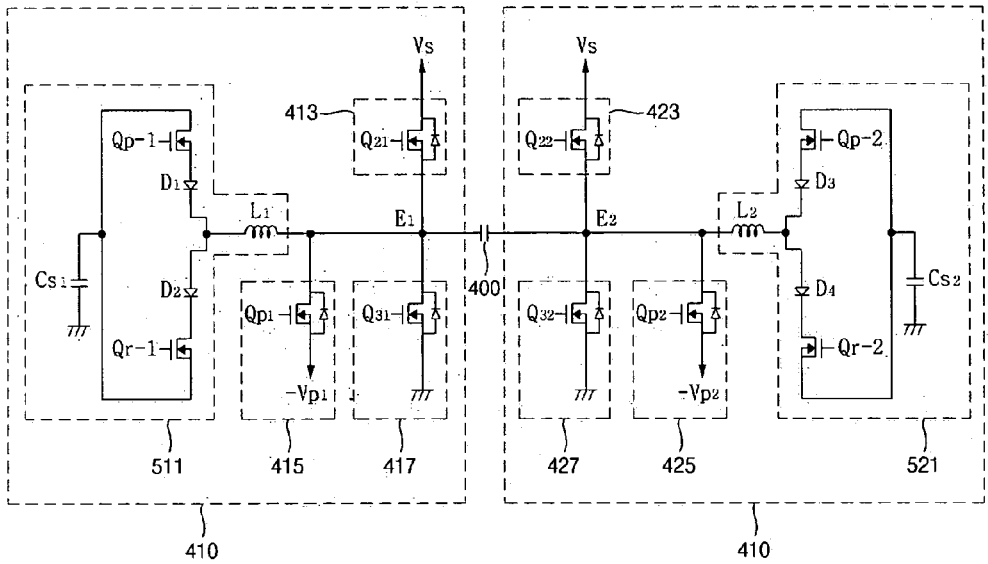
FIG. 5 is a diagram illustrating a plasma display apparatus according to a second embodiment of the present invention.

FIG. 5 shows a plasma display apparatus according to a second embodiment of the present invention. As shown in FIG. 5, the plasma display apparatus according to the second embodiment of the present invention comprises a plasma display panel 400 and an electrode driver 410.

The electrode driver 410 comprises a first energy recovery unit 511, a first positive voltage supply unit 413, a first negative voltage supply unit 415, a first reference voltage supply unit 417, a second energy recovery unit 521, a second positive voltage supply unit 423, a second negative voltage supply unit 425, and a second reference voltage supply unit 427.

The plasma display panel 400, the first positive voltage supply unit 413, the first negative voltage supply unit 415, the first reference voltage supply unit 417, the second positive voltage supply unit 423, the second negative voltage supply unit 425, and the second reference voltage supply unit 427 comprised in the plasma display apparatus according to the second embodiment of the present invention are the same as those of the first embodiment of the present invention and thus detailed descriptions thereof will be omitted.

<First Energy Recovery Unit>

The first energy recovery unit 511 supplies the first energy to the plasma display panel 400 through the first electrode (E1) with resonance and recovers the first energy from the plasma display panel 400 through the first electrode (E1) with resonance.

The first energy recovery unit 511 comprised in the plasma display apparatus according to the second embodiment of the present invention comprises a first energy recovery capacitor (Cs1), a first supply switch (Qp-1), a first recovery switch (Qr-1), a first diode (D1), a second diode (D2), and a first inductor (L1).

The first energy recovery capacitor (Cs1) stores the first energy which is supplied or recovered. The first energy stored in the first energy recovery capacitor (Cs1) corresponds to 0.5 times of the first positive voltage (Vs1).

The first supply switch (Qp-1) is turned on and forms a supply path of the first energy stored in the first energy recovery capacitor (Cs1). One terminal of the first supply switch (Qp-L1) is connected to the first energy recovery capacitor (Cs1) and the other terminal of the first supply switch (Qp-1) is connected to one terminal of the first inductor (L1).

The first recovery switch (Qr-1) is turned on and forms a recovery path of the first energy recovered to the first energy recovery capacitor (Cs1). One terminal of the first recovery switch (Qr-1) is connected to the first energy recovery capacitor (Cs1) and the other terminal of the first supply switch (Qp-1) is connected to one terminal of the first inductor (L1).

The first diode (D1) is connected between the first supply switch (Qp-1) and the first inductor (L1) and intercepts a countercurrent flowing to the first supply switch (Qp-1). An anode terminal of the first diode (D1) is connected to the other terminal of the first supply switch (Qp-1) and a cathode terminal of the first diode (D1) is connected to one terminal of the first inductor (L1).

The second diode (D2) is connected between the first recovery switch (Qr-1) and the first inductor (L1) and intercepts a countercurrent flowing to the first recovery switch (Qr-1). An anode terminal of the second diode (D2) is connected to one terminal of the first inductor (L1) and a cathode terminal of the second diode (D2) is connected to the other terminal of the first recovery switch (Qr-1).

The first inductor (L1) supplies the first energy supplied from the first energy recovery capacitor (Cs1) and the first supply switch (Qp-1) to the first electrode (E1) through resonance with a capacitance of the plasma display panel 400. In addition, the first inductor (L1) allows the first energy to be recovered from the first electrode (E1) to the first recovery switch (Qr-1) and the first energy recovery capacitor (Cs1) through resonance.

<Second Energy Recovery Unit>

The second energy recovery unit 521 comprised in the plasma display apparatus according to the second embodiment of the present invention comprises a second energy recovery capacitor (Cs2), a second supply switch (Qp-2), a second recovery switch (Qr-2), a third diode (D3), a fourth diode (D4), and a second inductor (L2).

The second energy recovery capacitor (Cs2) stores the second energy which is supplied or recovered. The second energy stored in the second energy recovery capacitor (Cs2) corresponds to 0.5 times of the second positive voltage (Vs2).

The second supply switch (Qp-2) is turned on and forms a supply path of the second energy stored in the second energy recovery capacitor (Cs2). One terminal of the second supply switch (Qp-2) is connected to the second energy recovery capacitor (Cs2) and the other terminal of the second supply switch (Qp-2) is connected to one terminal of the second inductor (L2).

The second recovery switch (Qr-2) is turned on and forms a recovery path of the second energy recovered to the second energy recovery capacitor (Cs2). One terminal of the second recovery switch (Qr-2) is connected to the second energy recovery capacitor (Cs2) and the other terminal of the second supply switch (Qp-2) is connected to one terminal of the second inductor (L2).

The third diode (D3) is connected between the second supply switch (Qp-2) and the second inductor (L2) and intercepts a countercurrent flowing to the second supply switch (Qp-2). An anode terminal of the third diode (D3) is connected to the other terminal of the second supply switch (Qp-2) and a cathode terminal of the third diode (D3) is connected to one terminal of the second inductor (L2).

The fourth diode (D2) is connected between the second recovery switch (Qr-2) and the second inductor (L2) and intercepts a countercurrent flowing to the second recovery switch (Qr-2). An anode terminal of the fourth diode (D4) is connected to one terminal of the second inductor (L2) and a cathode terminal of the fourth diode (D4) is connected to the other terminal of the second recovery switch (Qr-2).

The second inductor (L2) allows the second energy supplied from the second energy recovery capacitor (Cs2) and the second supply switch (Qp-2) to be supplied to the second electrode (E2) through resonance with a capacitance of the plasma display panel 400. In addition, the second inductor (L2) allows the second energy to be recovered from the second electrode (E2) to the second recovery switch (Qr-2) and the second energy recovery capacitor (Cs2) through resonance.

Figure 6:
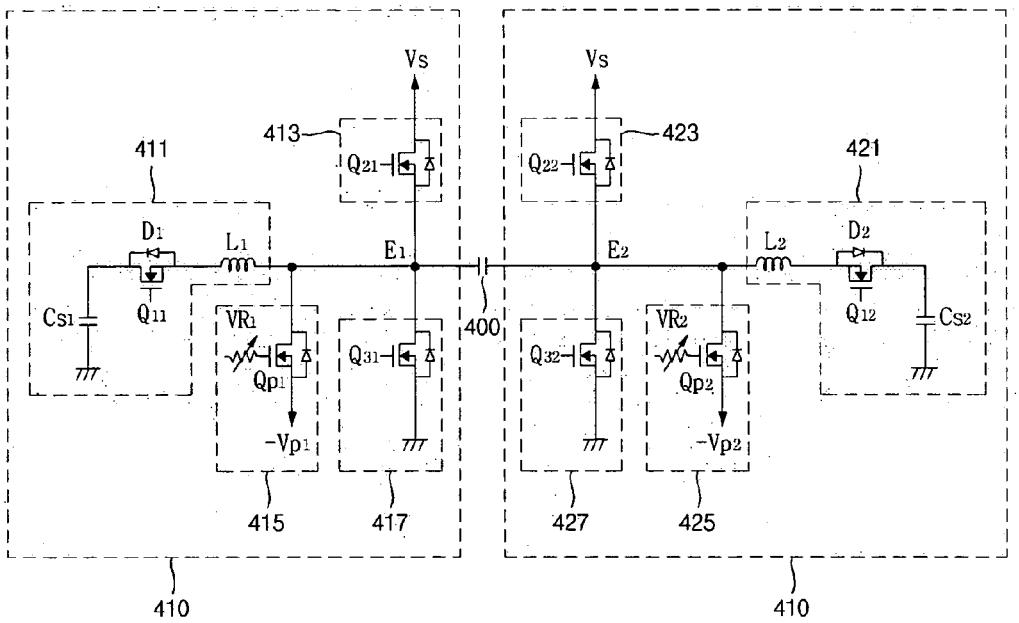
FIG. 6 is a diagram illustrating a plasma display apparatus according to a third embodiment of the present invention.

FIG. 6 shows a plasma display apparatus according to a third embodiment of the present invention. As shown in FIG. 6, a plasma display apparatus according to the third embodiment of the present invention comprises a plasma display panel 400 and an electrode driver 410.

The electrode driver 410 comprises a first energy recovery unit 411, a first positive voltage supply unit 413, a first negative voltage supply unit 415, a first reference voltage supply unit 417, a second energy recovery unit 421, a second positive voltage supply unit 423, a second negative voltage supply unit 425, and the second reference voltage supply unit 427.

The plasma display panel 400, the first energy recovery unit 411, the first positive voltage supply unit 413, the first reference voltage supply unit 417, the second energy recovery unit 421, the second positive voltage supply unit 423, and the second reference voltage supply unit 427 comprised in the plasma display apparatus according to the third embodiment of the present invention are the same as those of the first embodiment of the present invention and thus detailed descriptions thereof will be omitted.

<First Negative Voltage Supply Unit>

The first negative voltage supply unit 415 supplies a first negative voltage to the first electrode (E1) while the first energy is recovered or after the first energy is recovered to the first energy recovery unit 411. The first negative voltage supply unit 415 comprises a first negative voltage supply switch (Qp1). One terminal of the first negative voltage supply switch (Qp1) is connected to the first negative voltage source (−Vp1) and the other terminal of the first negative voltage supply switch (Qp1) is connected to the first electrode (E1) of the plasma display panel 400. The first negative voltage supply switch (Qp1) operates in an active area and a gate terminal of the first negative voltage supply switch (Qp1) is connected to the first variable resistor (VR1). A waveform of a voltage of the first electrode (E1) formed depending on an operation of the first negative voltage supply switch (Qp1) has a slope and is a waveform falling up to the first negative voltage (−Vp1). According to a magnitude of the first variable resistor (VR1), a size of a slope changes.

<Second Negative Voltage Supply Unit>

A second negative voltage supply unit 425 supplies the second negative voltage to the second electrode (E2) while the second energy is recovered or after the second energy is recovered to the second energy recovery unit 421. The second negative voltage supply unit 425 comprises the second negative voltage supply switch (Qp2). One terminal of the second negative voltage supply switch (Qp2) is connected to the second negative voltage source (−Vp2) and the other terminal of the second negative voltage supply switch (Qp2) is connected to the second electrode (E2) of the plasma display panel 400. The second negative voltage supply switch (Qp2) operates in an active area and a gate terminal of the second negative voltage supply switch (Qp2) is connected to the second variable resistor (VR2). A waveform of a voltage of the second electrode (E2) formed depending on an operation of the second negative voltage supply switch (Qp2) has a slope and is a waveform falling to the second negative voltage (−Vp2). According to a magnitude of the second variable resistor (VR2), a size of a slope changes.

Figure 7:
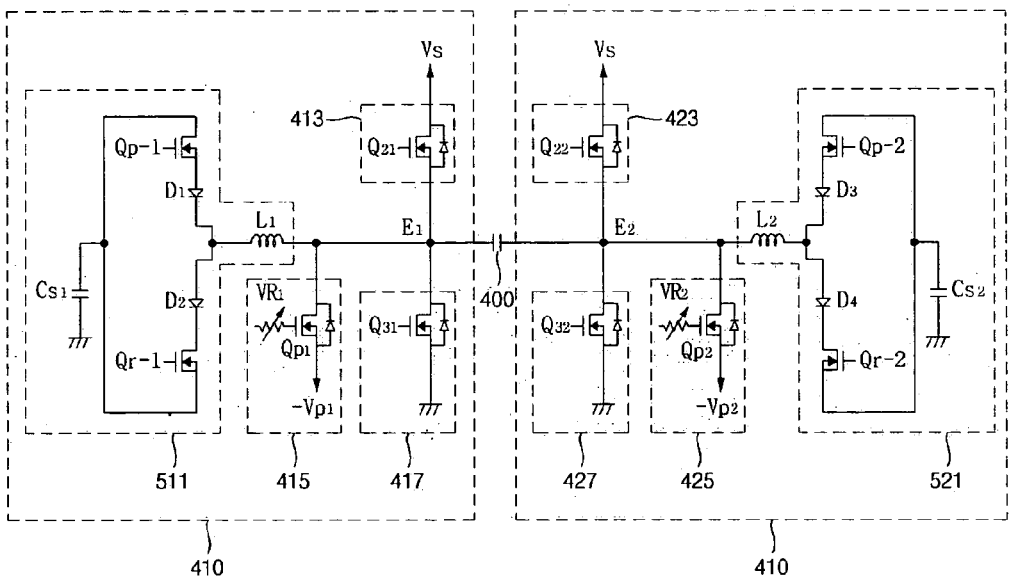
FIG. 7 is a diagram illustrating a plasma display apparatus according to a fourth embodiment of the present invention.

FIG. 7 shows a plasma display apparatus according to a fourth embodiment of the present invention. As shown in FIG. 7, a plasma display apparatus according to the fourth embodiment of the present invention comprises the plasma display panel 400 and the electrode driver 410.

The electrode driver 410 comprises a first energy recovery unit 411, a first positive voltage supply unit 413, a first negative voltage supply unit 415, a first reference voltage supply unit 417, a second energy recovery unit 421, a second positive voltage supply unit 423, a second negative voltage supply unit 425, and a second reference voltage supply unit 427.

The plasma display panel 400, the first energy recovery unit 411, the first positive voltage supply unit 413, the first reference voltage supply unit 417, the second energy recovery unit 421, the second positive voltage supply unit 423, and the second reference voltage supply unit 427 comprised in a plasma display apparatus according to the fourth embodiment of the present invention are the same as those of the third embodiment of the present invention and thus detailed descriptions thereof will be omitted.

<First Negative Voltage Supply Unit>

The first negative voltage supply unit 415 supplies the first negative voltage to the first electrode (E1) while the first energy is recovered or after the first energy is recovered to the first energy recovery unit 411. The first negative voltage supply unit 415 comprises a first negative voltage supply switch (Qp1). Connection to the first negative voltage supply switch (Qp1) is the same as that to the first negative voltage supply switch (Qp1) comprised in the second embodiment of the present invention and thus detailed descriptions thereof will be omitted. The first negative voltage supply switch (Qp1) operates in an active area and a gate terminal of the first negative voltage supply switch (Qp1) is connected to the first variable resistor (VR1). A waveform of a voltage of the first electrode (E1) formed depending on an operation of the first negative voltage supply switch (Qp1) has a slope and is a waveform falling up to the first negative voltage (−Vp1). According to a magnitude of the first variable resistor (VR1), a size of a slope changes.

<Second Negative Voltage Supply Unit>

The second negative voltage supply unit 425 supplies the second negative voltage to the second electrode (E2) while the second energy is recovered or after the second energy is recovered to the second energy recovery unit 421. The second negative voltage supply unit 425 comprises a second negative voltage supply switch (Qp2). Connection to the second negative voltage supply switch (Qp2) is the same as that to the second negative voltage supply switch (Qp2) comprised in the second embodiment of the present invention and thus the detailed descriptions thereof will be omitted. The second negative voltage supply switch (Qp2) operates in an active area and a gate terminal of the second negative voltage supply switch (Qp2) is connected to the second variable resistor (VR2). A waveform of a voltage of the second electrode (E2) formed depending on an operation of the second negative voltage supply switch (Qp2) has a slope and is a waveform falling up to the second negative voltage (−Vp2). According to a magnitude of the second variable resistor (VR2), a size of a slope changes.

Hereafter, a driving method of a plasma display apparatus according to an embodiment of the present invention will be described in detail with reference to the accompanying drawings.

Figure 8:
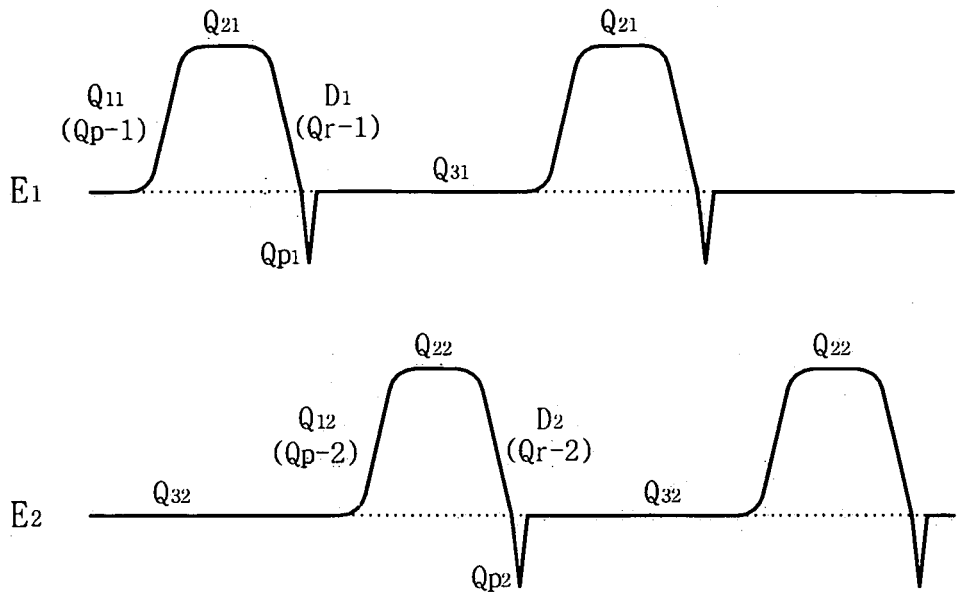
FIG. 8 is a diagram illustrating a first embodiment of a driving method of a plasma display apparatus of the present invention.

FIG. 8 shows a first embodiment of a driving method of a plasma display apparatus of the present invention. The first embodiment of a driving method of a plasma display apparatus of the present invention shown in FIG. 8 through a plasma display apparatus according to the first embodiment of the present invention shown in FIG. 4 will be described in detail.

When the first supply switch (Q11) and the second reference voltage supply switch (Q32) are turned on and the first positive voltage switch (Q21), the first negative voltage switch (Qp1), the first reference voltage supply switch (Q31), the second supply switch (Q12), the second positive voltage switch (Q22), and the second negative voltage switch (Qp2) are turned off, the first energy stored in the first energy recovery capacitor (Cs1) is supplied to the plasma display panel 400 through the first supply switch (Q11), the first inductor (L1), and the first electrode (E1). Because the first inductor (L1) and a capacitance of the plasma display panel 400 form resonance at a supply process of the first energy, a voltage of the first electrode (E1) rises up to the first positive voltage (Vs).

A switching state of the second reference voltage supply switch (Q32), the second supply switch (Q12), the second positive voltage switch (Q22), and the second negative voltage switch (Qp2) sustains the same state while a sustain pulse is applied to the first electrode (E1). Accordingly, a voltage of the second electrode (E2) sustains a ground level voltage.

When the first positive voltage switch (Q21) is turned on and the first supply switch (Q11), the first negative voltage switch (Qp1) and the first reference voltage supply switch (Q31) are turned off, a voltage of the first electrode (E1) sustains a first positive voltage (Vs).

When the first supply switch (Q11), the first positive voltage switch (Q21), the first negative voltage switch (Qp1), and the first reference voltage supply switch (Q31) are turned off, the first energy stored in the plasma display panel 400 is recovered to the first energy recovery capacitor (Cs1) through the first electrode (E1), the first inductor (L1), and the first recovery diode (D1). Because the first inductor (L1) and a capacitance of the plasma display panel 400 forms resonance at a process of recovering the first energy, a voltage of the first electrode (E1) falls from a positive voltage (Vs) to a ground level voltage.

When the first negative voltage switch (Qp1) is turned on and the first supply switch (Q11), the first positive voltage switch (Q21), and the first reference voltage supply switch (Q31) are turned off, a voltage of the first electrode (E1) abruptly falls up to the first negative voltage (−Vp1).

When the first reference voltage supply switch (Q31) is turned on and the first supply switch (Q11), the first positive voltage switch (Q21), and the first negative voltage switch (Qp1) are turned off, a voltage of the first electrode (E1) sustains a ground level voltage.

After a sustain pulse and a negative peak pulse are applied to the first electrode (E1), they are applied to the second electrode (E2). That is, when the second supply switch (Q12) and the first reference voltage supply switch (Q31) are turned on and the second positive voltage switch (Q22), the second negative voltage switch (Qp2), the second reference voltage supply switch (Q32), the first supply switch (Q11), the first positive voltage switch (Q21), and the first negative voltage switch (Qp1) are turned off, the second energy stored in the second energy recovery capacitor (Cs2) is supplied to the plasma display panel 400 through the second inductor (L2) and the second electrode (E2). Because a capacitance of the plasma display panel 400 and the second inductor (L2) forms resonance at a process of supplying the second energy, a voltage of the second electrode (E2) rises up to a second positive voltage (Vs).

A switching state of the first reference voltage supply switch (Q31), the first supply switch (Q11), the first positive voltage switch (Q21), and the first negative voltage switch (Qp1) sustains the same state while a sustain pulse is applied to the second electrode (E1). Accordingly, a voltage of the first electrode (E1) sustains a ground level voltage.

When the second positive voltage switch (Q22) is turned on and the second supply switch (Q12), the second negative voltage switch (Qp2), and the second reference voltage supply switch (Q32) are turned off, a voltage of the second electrode (E2) sustains the second positive voltage (Vs).

When the second supply switch (Q12), the second positive voltage switch (Q22), the second negative voltage switch (Qp2), and the second reference voltage supply switch (Q32) are turned off, the second energy stored in the plasma display panel 400 are recovered to the second energy recovery capacitor (Cs2) through the second electrode (E2) and the second recovery diode (D2). Because a capacitance of the plasma display panel 400 and the second inductor (L2) forms resonance at a process of recovering the second energy, a voltage of the second electrode (E2) falls from a second positive voltage (Vs) to a ground level voltage.

When the second negative voltage switch (Qp2) is turned on and the second supply switch (Q12), the second positive voltage switch (Q22), and the second reference voltage supply switch (Q32) are turned off, a voltage of the second electrode (E2) abruptly falls up to the second negative voltage (−Vp2).

When the second reference voltage supply switch (Q32) is turned on and the second supply switch (Q12), the second positive voltage switch (Q22), and the second negative voltage switch (Qp2) are turned off, a voltage of the second electrode (E2) sustains a ground level voltage.

As the first negative voltage switch (Qp1) or the second negative voltage switch (Qp2) is turned on, a negative peak pulse is supplied upon falling of a sustain pulse supplied to the first electrode (E1) or the second electrode (E2). Because a negative peak pulse pushes out electrons formed on the first electrode (E1) that is a scan electrode or the second electrode (E2) that is a sustain electrode to a discharge space, many space charges are formed in the discharge space. When many space charges remains in a discharge space, continuous discharge can be performed with a low driving voltage at a sustain process.

That is, in a driving method by an operation of the plasma display apparatus according to the first embodiment of the present invention, as light emitting is continuously performed under a low driving voltage by forming many space charges, an effect of using appositive column area is obtained.

A process of applying a negative peak pulse to the first electrode (E1) and the second electrode (E2) when a voltage falls can be performed by the plasma display apparatus according to the second embodiment of the present invention shown in FIG. 5.

That is, when the first supply switch (Qp-1) and the second reference voltage supply switch (Q32) of FIG. 5 are turned on and the first recovery switch (Qr-1), the first positive voltage switch (Q21), the first negative voltage switch (Qp1), the first reference voltage supply switch (Q31), the second supply switch (Qp-2), the second recovery switch (Qr-2), the second positive voltage switch (Q22), the second negative voltage switch (Qp2) are turned off, the first energy stored in the first energy recovery capacitor (Cs1) is supplied to the plasma display panel 400 through the first supply switch (Qp-1), the first inductor (L1), and the first electrode (E1). Because the first inductor (L1) and a capacitance of the plasma display panel 400 form resonance at a process of supplying the first energy, a voltage of the first electrode (E1) rises up to first positive voltage (Vs).

In addition, when the first recovery switch (Qr-1) and the second reference voltage supply switch (Q32) of FIG. 5 are turned on and the first supply switch (Qp-1), the first positive voltage switch (Q21), the first negative voltage switch (Qp1), the first reference voltage supply switch (Q31), the second supply switch (Qp-2), the second recovery switch (Qr-2), the second positive voltage switch (Q22), and the second negative voltage switch (Qp2) are turned off, the first energy stored in the plasma display panel 400 is recovered to the first energy recovery capacitor (Cs1) through the first electrode (E1), the first inductor (L1), and the first recovery switch (Qr-1). Because the first inductor (L1) and a capacitance of the plasma display panel 400 forms resonance at a process of recovering the first energy, a voltage of the first electrode (E1) falls from a first positive voltage (Vs) to a ground level voltage.

When the second supply switch (Qp-2) and the first reference voltage supply switch (Q31) of FIG. 5 are turned on and the first supply switch (Qp-1), the first recovery switch (Qr-1), the first positive voltage switch (Q21), the first negative voltage switch (Qp1), the first reference voltage supply switch (Q31), the second recovery switch (Qr-2), the second positive voltage switch (Q22), and the second negative voltage switch (Qp2) are turned off, the second energy stored in the second energy recovery capacitor (Cs2) is supplied to the plasma display panel 400 through the second supply switch (Qp-2), the second inductor (L2), and the second electrode (E2). Because the second inductor (L2) and the capacitance of the plasma display panel 400 forms resonance at a process of supplying the second energy, a voltage of the second electrode (E2) rises up to a second positive voltage (Vs).

In addition, when the second recovery switch (Qr-2) and the first reference voltage supply switch (Q31).of FIG. 5 are turned on and the first supply switch (Qp-1), the first recovery switch (Qr-1), the first positive voltage switch (Q21), the first negative voltage switch (Qp1), the second reference voltage supply switch (Q32), the second supply switch (Qp-2), the second positive voltage switch (Q22), and the second negative voltage switch (Qp2) are turned off, the second energy stored in the plasma display panel 400 is recovered to the second energy recovery capacitor (Cs2) through the second electrode (E2), the second inductor (L2), and the second recovery switch (Qr-2). Because the second inductor (L2) and the capacitance of the plasma display panel 400 forms resonance at a process of recovering the second energy, a voltage of the second electrode (E2) falls from the second positive voltage (Vs) to a ground level voltage.

Processes except a process of supplying and recovering energy through the plasma display apparatus according to the second embodiment of the present invention are the same as an operation of the plasma display apparatus according to the first embodiment of the present invention and thus the detailed descriptions thereof will be omitted.

In a driving method by an operation of a plasma display apparatus according to the second embodiment of the present invention, as light emitting is continuously performed under a low driving voltage by forming many space charges, an effect of using a positive column area is obtained.

Figure 9:
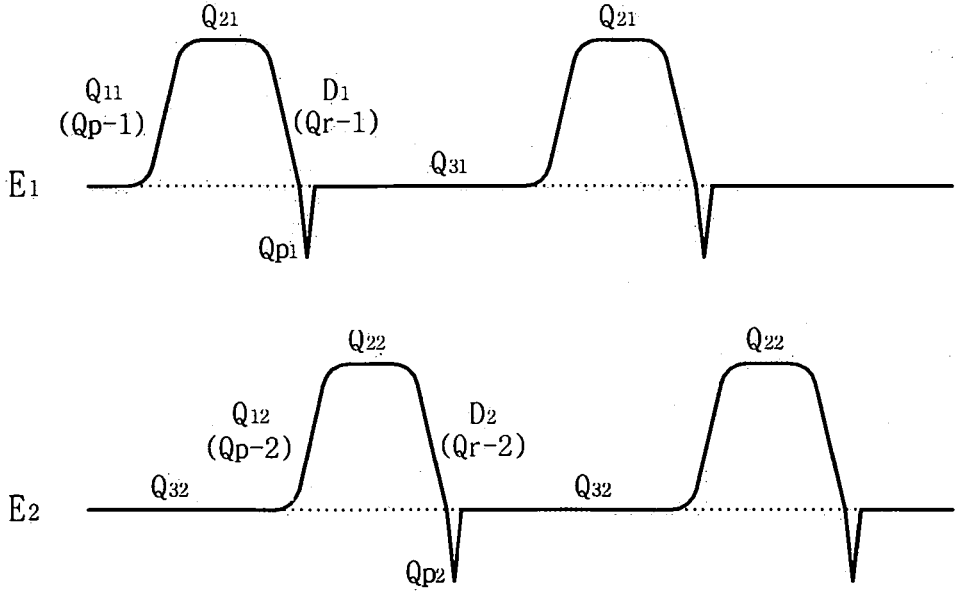
FIG. 9 is a diagram illustrating a second embodiment of a driving method of a plasma display apparatus of the present invention.

FIG. 9 shows a second embodiment of a driving method of a plasma display apparatus of the present invention. The second embodiment of a driving method of the plasma display apparatus of the present invention shown in FIG. 9 through the plasma display apparatus according to the third embodiment of the present invention shown in FIG. 6 will be described in detail.

In the second embodiment of a driving method of the plasma display apparatus of the present invention shown in FIG. 9, when a negative peak pulse is applied to one electrode of the first electrode (E1) and the second electrode (E2), the pulse overlaps with a sustain pulse applied to the other electrode thereof.

A process of supplying the first energy stored in the first energy recovery capacitor (Cs1) to the plasma display panel 400 through the first supply switch (Q11), the first inductor (L1), and the first electrode (E1) process, a process of sustaining a voltage of the first electrode (E1) to the first positive voltage (Vs), and a process of recovering the first energy supplied in the plasma display panel 400 to the first energy recovery capacitor (Cs1) through the first electrode (E1), the first inductor (L1), and the first recovery diode (D1) are the same as those in the first embodiment of a driving method of the plasma display apparatus of the present invention shown in FIG. 8 and thus detailed descriptions thereof will be omitted.

When the first negative voltage switch (Qp1) is turned on and the first supply switch (Q11), the first positive voltage switch (Q21), and the first reference voltage supply switch (Q31) are turned off, a voltage of the first electrode (E1) abruptly falls up to the first negative voltage (−Vp1). That is, a negative peak pulse is applied to the first electrode (E1).

When a negative peak pulse is applied to the first electrode (E1), the second supply switch (Q12) is turned on and the second positive voltage switch (Q22), the second negative voltage switch (Qp2), the second reference voltage supply switch (Q32) are turned off. Accordingly, a section in which a negative peak pulse is applied to the first electrode (E1) overlaps with a section in which a voltage of the second electrode (E2) rises to a second positive voltage (Vs).

When the first reference voltage supply switch (Q31) is turned on and the first supply switch (Q11), the first positive voltage switch (Q21), and the first negative voltage switch (Qp1) are turned off after a negative peak pulse is applied to the first electrode (E1), a voltage of the first electrode (E1) sustains a ground level voltage.

A process of sustaining a voltage of the second electrode (E2) to the second positive voltage (Vs) and a process of recovering the second energy stored in the plasma display panel 400 to the second energy recovery capacitor (Cs2) through the second electrode (E2), the second inductor (L2), and the second recovery diode (D2) are the same as those in the first embodiment of a driving method of a plasma display apparatus of the present invention shown in FIG. 8 and thus detailed descriptions thereof will be omitted.

When the second negative voltage switch is turned on and the second supply switch (Q12), the second positive voltage switch (Q22), and the second reference voltage supply switch (Q32) are turned off, a voltage of the second electrode (E2) abruptly falls up to the second negative voltage (−Vp2).

After the second energy is recovered to the second energy recovery capacitor (Cs2), the second negative voltage switch (Qp2) is turned on and the second supply switch (Q12), the second positive voltage switch (Q22), and the second reference voltage supply switch (Q32) are turned off. A voltage of the second electrode (E2) abruptly falls to the second negative voltage (−Vp2). That is, a negative peak pulse is supplied to the second electrode (E2). When a negative peak pulse is applied to the second electrode (E2), the first supply switch (Q11) is turned on and the first positive voltage switch (Q21), the first negative voltage switch (Qp1), and the first reference voltage supply switch (Q31) are turned off. Accordingly, a section in which a negative peak pulse is applied to the second electrode (E2) overlaps with a section in which a voltage of the first electrode (E1) rises to a first positive voltage (Vs).

Because a negative peak pulse push out an electron formed on the first electrode (E1) that is a scan electrode or the second electrode (E2) that is a sustain electrode, light emitting is continuously performed under a driving voltage by forming many space charges in a discharge space, so that an effect of using a positive column area is obtained. In addition, because a section in which a negative peak pulse is applied to one electrode of the first electrode (E1) and the second electrode (E2) overlaps with a section in which a voltage of the other electrode thereof rises up to a positive voltage, electrons pushed out by a negative peak pulse are quickly moved to other electrodes, so that an amount of charges remaining on the electrode decreases and thus an afterimage as well as a noise are removed.

The second embodiment of a driving method of the plasma display apparatus of the present invention can be preformed by the plasma display apparatus according to the second embodiment of the present invention shown in FIG. 5.

That is, the first supply switch (Qp-1) and the first recovery switch (Qr-1) of FIG. 5 take the place of functions of the first supply switch (Q11) and the first recovery diode (D1) of FIG. 4 and the second supply switch (Qp-2) and the second recovery switch (Qr-2) of FIG. 5 take the place of functions of the second supply switch (Q12) and the second recovery diode (D2) of FIG. 4.

In the plasma display apparatus according to the second embodiment of the present invention, because a negative peak pulse pushes out electrons formed on the first electrode (E1) that is a scan electrode or the second electrode (E2) that is a sustain electrode to a discharge space, light emitting is continuously performed under a low driving voltage by forming many space charges in a discharge space, so that an effect of using a positive column area is obtained.

In addition, in the plasma display apparatus according to the second embodiment of the present invention, a section in which a negative peak pulse is applied to one electrode of the first electrode (E1) or the second electrode (E2) overlaps with that in which a voltage of the other electrode thereof rises up to positive voltage and thus electrons pushed by a negative peak pulse are quickly moved to other electrode, so that an amount of charges remaining on the electrode decreases and thus an afterimage as well as a noise are removed.

Figure 10:
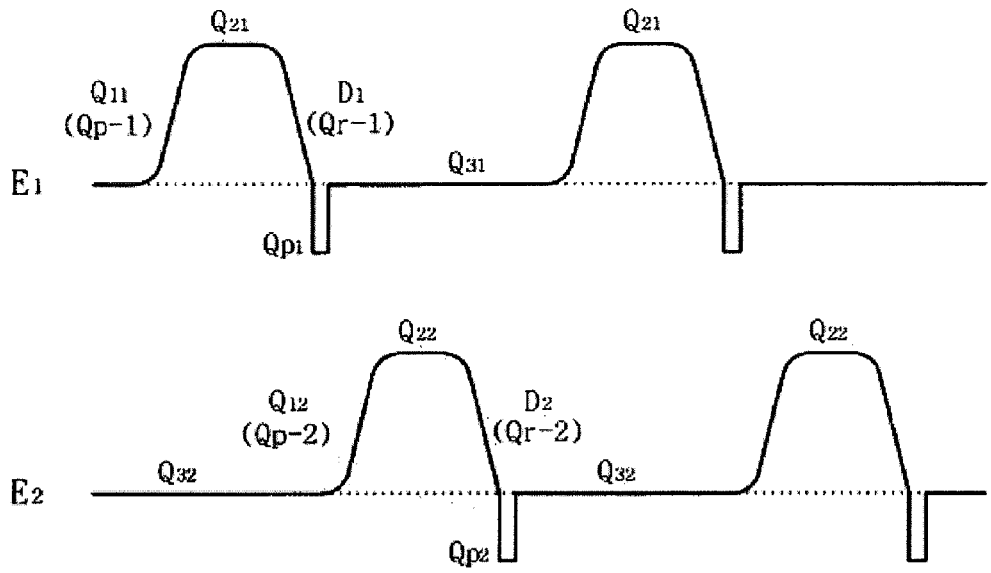
FIG. 10 is a diagram illustrating a third embodiment of a driving method of a plasma display apparatus of the present invention.

FIG. 10 shows a third embodiment of a driving method of a plasma display apparatus of the present invention. The third embodiment of a driving method of the plasma display apparatus of the present invention shown in FIG. 10 through the plasma display apparatus according to the first embodiment of the present invention shown in FIG. 4 will be described in detail.

A process of supplying the first energy stored in the first energy recovery capacitor (Cs1) to the plasma display panel 400 through the first supply switch (Q11), the first inductor (L1), and the first electrode (E1), a process of sustaining a voltage of the first electrode (E1) to the first positive voltage (Vs), and a process of recovering the first energy stored in the plasma display panel 400 to the first energy recovery capacitor (Cs1) through the first electrode (E1), the first inductor (L1), and the first recovery diode (D1) are the same as those in the first embodiment of a driving method of the plasma display apparatus of the present invention shown in FIG. 8 and thus detailed descriptions thereof will be omitted.

When the first negative voltage switch (Qp1) is turned on and sustains a turn on state during a predetermined time and the first supply switch (Q11), the first positive voltage switch (Q21), and the first reference voltage supply switch (Q31) are turned off after the first energy is recovered to the first energy recovery capacitor (Cs1), a voltage of the first electrode (E1) sustains the first negative voltage (−Vp1) after abruptly falling up to the first negative voltage (−Vp1). Therefore, a negative peak pulse of a square waveform is applied to the first electrode (E1).

After a negative peak pulse of a square waveform is applied to the first electrode (E1), a sustain pulse is applied to the second electrode (E2). In a process of supplying a sustain pulse to the second electrode (E2), a process of rising a voltage of the second electrode (E2) to the second positive voltage (Vs), a process of sustaining a voltage of the second electrode (E2) to the second positive voltage (Vs), and a process of recovering the second energy stored in the plasma display panel 400 to the second energy recovery capacitor (Cs2) through the second electrode (E2), the second inductor (L2), and the second recovery diode (D2) are the same as those in the first embodiment of a driving method of the plasma display apparatus of the present invention shown in FIG. 8 and thus detailed descriptions thereof will be omitted.

When the second negative voltage switch (Qp2) is turned on and sustains a turn on state during a predetermined time and the second supply switch (Q12), the second positive voltage switch (Q22), and the second reference voltage supply switch (Q32) are turned off after the second energy is recovered to the second energy recovery capacitor (Cs2), a voltage of the second electrode (E2) sustains the second negative voltage (−Vp2) after abruptly falling up to the second negative voltage (−Vp2). Therefore, a negative peak pulse of a square waveform is applied to the second electrode (E2).

That is, in a driving method according to the first embodiment and the second embodiment of the present invention, after the first negative voltage switch (Q21) or the second negative voltage switch (Q22) of FIGS. 4 and 5 is turned on, it is immediately turned off and a negative peak pulse of a triangular waveform is applied to the first electrode (E1) or the second electrode (E2). In a driving method according to the third embodiment of the present invention, the first negative voltage switch (Q21) or the second negative voltage switch (Q22) of FIGS. 4 and 5 is turned on and sustains a turn on state during a predetermined time, so that a negative peak pulse of a square waveform is applied to the first electrode (E1) or the second electrode (E2).

In the third embodiment of a driving method of the plasma display apparatus according to the present invention, as many space charges are formed by supplying a negative peak pulse of a square waveform, an effect of using a positive column area is obtained. In addition, a negative peak pulse of a square waveform is apt to form than that of a triangular waveform; In the third embodiment of a driving method of the plasma display apparatus according to the present invention, many space charges can be easily formed due to a sustain time of a negative voltage.

A process of applying a negative peak pulse of a square waveform to the first electrode (E1) and the second electrode (E2) can be preformed by the plasma display apparatus according to the second embodiment of the present invention shown in FIG. 5.

That is, the first supply switch (Qp-1) and the first recovery switch (Qr-1) of FIG. 5 take the place of functions of the first supply switch (Q11) and the first recovery diode (D1) of FIG. 4 and the second supply switch (Qp-2) and the second recovery switch (Qr-2) of FIG. 5 take the place of functions of the second supply switch (Q12) and the second recovery diode (t)2) of FIG. 4.

Figure 11:
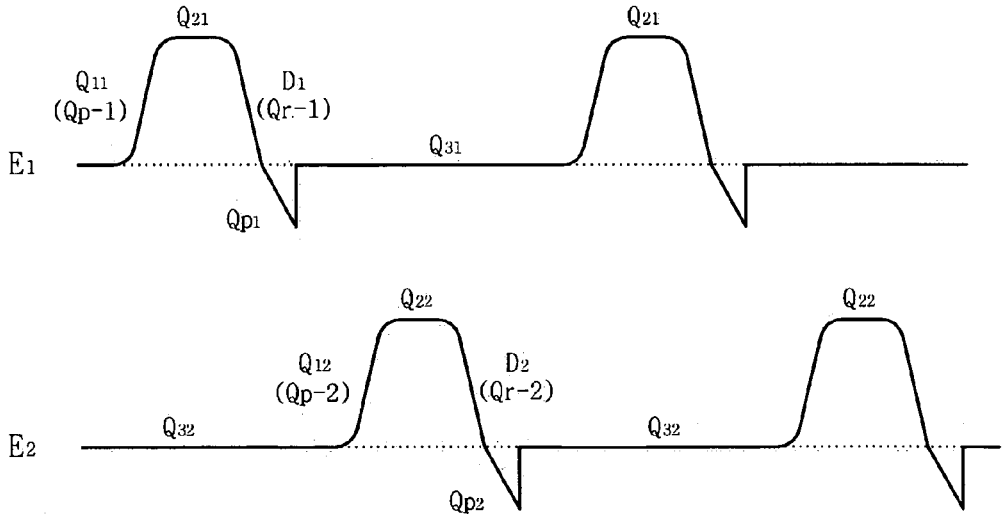
FIG. 11 is a diagram illustrating a fourth embodiment of a driving method of a plasma display apparatus of the present invention.

FIG. 11 shows a fourth embodiment of a driving method of a plasma display apparatus of the present invention. The fourth embodiment of a driving method of the plasma display apparatus of the present invention shown in FIG. 11 through the plasma display apparatus according to the third embodiment of the present invention shown in FIG. 6 will be described in detail.

A process of supplying the first energy stored in the first energy recovery capacitor (Cs1) to the plasma display panel 400 through the first supply switch (Q11), the first inductor (L1), and the first electrode (E1), a process of sustaining a voltage of the first electrode (E1) to the first positive voltage (Vs), and a process of recovering the first energy stored in the plasma display panel 400 to the first energy recovery capacitor (Cs1) through the first electrode (E1), the first inductor (L1), and the first recovery diode (D1) are the same as those in the first embodiment of a driving method of the plasma display apparatus of the present invention shown in FIG. 8 and thus detailed descriptions thereof will be omitted.

When the first negative voltage switch (Qp1) operating in an active area is turned on and the first supply switch (Q11), the first positive voltage switch (Q21), and the first reference voltage supply switch (Q31) are turned off after the first energy is recovered to the first energy recovery capacitor (Cs1), a voltage of the first electrode (E1) has a slope and falls up to the first negative voltage (−Vp1). That is, a negative peak pulse of a ramp pulse form is applied to the first electrode (E1). As a magnitude of the first variable resistor (VR1) changes, a size of a slope changes.

When the first reference voltage supply switch (Q31) is turned on and the first supply switch (Q11), the first positive voltage switch (Q21), and the first negative voltage switch (Qp1) are turned off after a negative peak pulse of a ramp pulse form is applied to the first electrode (E1), a voltage of the first electrode (E1) sustains a ground level voltage.

After a voltage of the first electrode (E1) sustains a ground level voltage, a negative peak pulse of a sustain pulse and a ramp pulse form is applied to the second electrode (E2).

A process of rising a voltage of the second electrode (E2) to the second positive voltage (Vs), a process of sustaining a voltage of the second electrode (E2) to the second positive voltage (Vs), and a process of recovering the second energy stored in the plasma display panel 400 to the second energy recovery capacitor (Cs2) through the second electrode (E2), the second inductor (L2), and the second recovery diode (D2) are the same as those in the first embodiment of a driving method of the plasma display apparatus of the present invention shown in FIG. 8 and thus the detailed descriptions will be omitted.

When the second negative voltage switch (Qp2) operating in an active area is turned on and the second supply switch (Q12), the second positive voltage switch (Q22), and the second reference voltage supply switch (Q32) are turned off after the first energy is recovered to the first energy recovery capacitor (Cs2), a voltage of the second electrode (E2) has a slope and falls up to the second negative voltage (−Vp2). That is, a negative peak pulse of a ramp pulse form is applied to the second electrode (E2). If a magnitude of the second variable resistor (VR2) changes, a size of slope changes.

When the second reference voltage supply switch (Q32) is turned on and the second supply switch (Q12), the second positive voltage switch (Q22), and the second negative voltage switch (Qp2) are turned off after a negative peak pulse of a ramp pulse form is applied to the second electrode (E2), a voltage of the second electrode (E2) sustains a ground level voltage.

The fourth embodiment of a driving method of the plasma display apparatus of the present invention can be performed by the plasma display apparatus according to the fourth embodiment of the present invention shown in FIG. 7.

That is, the first supply switch (Qp-1) and the first recovery switch (Qr-1) of FIG. 7 takes the place of functions of the first supply switch (Q11) and the first recovery diode (D1) of FIG. 6 and the second supply switch (Qp-2) and the second recovery switch (Qr-2) of FIG. 7 take the place of functions of the second supply switch (Q12) and the second recovery diode (D2) of FIG. 6.

In the fourth embodiment of a driving method of the plasma display apparatus according to the present invention, as many space charges are formed by supplying a negative peak pulse of a ramp form, an effect using a positive column area is obtained.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus, comprising:

a plasma display panel comprising a first electrode and a second electrode;

a first energy recovery unit supplying the first energy to the plasma display panel through the first electrode with resonance or recovering the first energy from the plasma display panel through the first electrode with resonance;

a first positive voltage supply unit supplying a first positive voltage to the first electrode after the first energy is supplied;

a first negative voltage supply unit supplying a first negative voltage to the first electrode while the first energy is recovered or after the first energy is recovered;

a second energy recovery unit supplying a second energy to the plasma display panel through the second electrode with resonance or recovering the second energy from the plasma display panel through the second electrode with resonance;

a second positive voltage supply unit supplying a second positive voltage to the second electrode after the second energy is supplied; and a second negative voltage supply unit supplying the second negative voltage to the second electrode while the second energy is recovered or after the second energy is recovered, wherein the first negative voltage supply unit comprises a first negative voltage supply switch having a first gate terminal, the first gate terminal being connected to a first variable resistor and operating in an active area, and wherein the second negative voltage supply unit comprises a second negative voltage supply switch having a second gate terminal, the second gate terminal being connected to a second variable resistor and operating in an active area.

2. The plasma display apparatus of claim 1, wherein the first positive voltage is a positive sustain voltage for sustaining discharge.

3. The plasma display apparatus of claim 1, wherein the second positive voltage is a positive sustain voltage for sustaining discharge.

4. The plasma display apparatus of claim 1, wherein the first energy corresponds to 0.5 times of the first positive voltage.

5. The plasma display apparatus of claim 1, wherein the second energy corresponds to 0.5 times of the second positive voltage.

6. The plasma display apparatus of claim 1, wherein the first energy recovery unit comprises a first energy recovery capacitor storing the first energy, a first supply switch forming a supply path of the first energy stored in the first energy recovery capacitor, a first recovery diode forming a recovery path of the first energy which is recovered through the first electrode, and a first inductor forming resonance when the first energy is supplied or recovered; and the second energy recovery unit comprises a second energy recovery capacitor storing the second energy, a second supply switch forming a supply path of the second energy stored in the second energy recovery capacitor, a second recovery diode forming a recovery path of the second energy recovered through the second electrode, and a second inductor forming resonance when the second energy is supplied or recovered.

7. The plasma display apparatus of claim 6, wherein the first recovery diode comprises a cathode terminal commonly connected to one terminal of the first supply switch and one terminal of the first energy recovery capacitor, and an anode terminal commonly connected to the other terminal of the first supply switch and one terminal of the first inductor, and the second recovery diode comprises a cathode terminal commonly connected to one terminal of the second supply switch and one terminal of the second energy recovery capacitor, and an anode terminal commonly connected to the other terminal of the second supply switch and one terminal of the second inductor.

8. The plasma display apparatus of claim 7, wherein the first recovery diode is a body diode of the first supply switch.

9. The plasma display apparatus of claim 7, wherein the second recovery diode is a body diode of the second supply switch.

10. The plasma display apparatus of claim 1, wherein the first energy recovery unit comprises a first energy recovery capacitor storing the first energy, a first supply switch forming a supply path of the first energy stored in the first energy recovery capacitor, a first recovery switch forming a recovery path of the first energy recovered to the first energy recovery capacitor, and a first inductor; and the second energy recovery unit comprises a second energy recovery capacitor storing the second energy, a second supply switch forming a supply path of the second energy stored in the second energy recovery capacitor, a second recovery switch forming a recovery path of the second energy recovered to the second energy recovery capacitor, and a second inductor supplying or recovering the second energy with resonance.

11. The plasma display apparatus of claim 1, wherein the first negative voltage supply unit supplies the first negative voltage having a ramp waveform and the second negative voltage supply unit supplies the second negative voltage having a ramp waveform.

12. The plasma display apparatus of claim 1, wherein the first negative voltage supply unit supplies the first negative voltage having a square waveform and the second negative voltage supply unit supplies the second negative voltage having a square waveform.

13. The plasma display apparatus of claim 1, wherein the first negative voltage supply unit supplies the first negative voltage having a triangular waveform and the second negative voltage supply unit supplies the second negative voltage having a triangular waveform.

* * * * *